US011225890B2

(12) United States Patent
Yang

(10) Patent No.: US 11,225,890 B2
(45) Date of Patent: Jan. 18, 2022

(54) EXHAUST SOUND CONTROL SYSTEM FOR VEHICLES

(71) Applicants: Hyundai Motor Company, Seoul (KR); Kia Motors Corporation, Seoul (KR)

(72) Inventor: Young Dug Yang, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 607 days.

(21) Appl. No.: 16/253,924

(22) Filed: Jan. 22, 2019

(65) Prior Publication Data

US 2020/0116057 A1 Apr. 16, 2020

(30) Foreign Application Priority Data

Oct. 10, 2018 (KR) ..... 10-2018-0120567

(51) Int. Cl.
*F01N 1/16* (2006.01)
*F01N 13/08* (2010.01)

(52) U.S. Cl.
CPC ..... *F01N 1/16* (2013.01); *F01N 13/08* (2013.01)

(58) Field of Classification Search
CPC ..... F02M 35/1294; F01N 1/16; F01N 1/163; F01N 13/08; G10K 11/18; G10K 11/22
See application file for complete search history.

(56) References Cited

U.S. PATENT DOCUMENTS 6,644,436 B2 * 11/2003 Hofmann ..... F02B 77/13 181/214
6,848,410 B2 * 2/2005 Hoffmann ..... G10K 11/22 123/184.57
7,353,791 B2 * 4/2008 Sasaki ..... F02M 35/10019 123/184.53
7,487,857 B2 * 2/2009 Wolf ..... G10K 11/22 181/229
7,506,626 B2 * 3/2009 Sasaki ..... F02M 35/1294 123/184.53
7,621,370 B2 * 11/2009 Abe ..... F02M 35/10137 123/184.57
8,127,888 B1 * 3/2012 Mah ..... F02M 35/1283 181/271
8,177,022 B2 * 5/2012 Honji ..... B60R 13/08 181/175

(Continued)

FOREIGN PATENT DOCUMENTS

JP 02248610 A * 10/1990 ..... G10K 11/22
KR 10-1298481 B1 8/2013

*Primary Examiner* — Jeremy A Luks
(74) *Attorney, Agent, or Firm* — Morgan, Lewis & Bockius LLP

(57) ABSTRACT

An exhaust sound control system for vehicles includes an exhaust valve device that controls the volume of exhaust sound by controlling the amount of exhaust gas flowing through a muffler. In a sporty driving mode, exhaust sound is permitted to be transferred to the interior of the vehicle, and in a silent driving mode, the volume of exhaust sound transferred to the interior the vehicle is minimized. The volume of exhaust sound transferred to the interior of the vehicle is varied depending on the driving mode desired by the driver. Accordingly, the sensorial quality related to sound generated while driving is improved.

8 Claims, 6 Drawing Sheets

(56) References Cited

U.S. PATENT DOCUMENTS

| | | | | |
|---|---|---|---|---|
| 8,322,486 | B2 * | 12/2012 | Ohta | F02M 35/10295 181/229 |
| 8,634,574 | B2 * | 1/2014 | Mah | B60R 13/08 381/86 |
| 9,097,222 | B2 * | 8/2015 | Cho | F02M 35/1294 |
| 9,706,322 | B2 * | 7/2017 | Cox | H04R 29/00 |
| 9,790,903 | B2 * | 10/2017 | Takahashi | G10K 11/22 |
| 9,926,896 | B2 * | 3/2018 | Nakashima | F02M 35/1294 |
| 10,645,489 | B2 * | 5/2020 | Toda | G10K 15/02 |
| 10,753,325 | B2 * | 8/2020 | Hayashi | F02B 33/44 |
| 2005/0121254 | A1 * | 6/2005 | Hofmann | G10K 11/22 181/237 |
| 2005/0121255 | A1 * | 6/2005 | Hofmann | F02M 35/1294 181/250 |
| 2005/0133300 | A1 * | 6/2005 | Hofmann | F02M 35/1294 181/250 |
| 2007/0044747 | A1 * | 3/2007 | Sawatari | F02M 35/1261 123/184.21 |
| 2007/0186895 | A1 * | 8/2007 | Ochi | F02M 35/1294 123/198 E |
| 2009/0000587 | A1 * | 1/2009 | Seko | F02M 35/1272 123/184.57 |

* cited by examiner

EXHAUST SOUND CONTROL SYSTEM FOR VEHICLES

CROSS-REFERENCE TO RELATED APPLICATION

This application claims the benefit of priority to Korean Patent Application No. 10-2018-0120567, filed on Oct. 10, 2018 in the Korean Intellectual Property Office, the disclosure of which is incorporated herein by reference.

TECHNICAL FIELD

The present disclosure relates to an exhaust sound control system for vehicles, which is capable of selectively transferring the exhaust sound of a vehicle to the interior of the vehicle, thereby improving the sensorial quality related to sound generated while driving.

BACKGROUND

In general, exhaust gas, which is generated by combustion in the engine of a vehicle, is discharged to the atmosphere through an exhaust valve and an exhaust passage. The exhaust speed is close to the speed of sound, and the temperature and pressure of exhaust gas are very high. Thus, if exhaust gas is directly discharged to the atmosphere, t expands sharply and makes an explosion sound. An exhaust passage, through which exhaust gas passes, includes a catalytic converter, which oxidizes and reduces harmful elements contained in the exhaust gas delivered from an exhaust manifold to harmless elements, and a muffler, which discharges the exhaust gas to the outside while reducing exhaust noise by reducing the temperature and pressure of the exhaust gas. These components are connected to each other via pipes.

On the other hand, the exhaust sound of a vehicle may give the driver plenty of driving pleasure. However, the transfer of the exhaust sound from the exhaust passage to the interior of the vehicle may be interrupted by the door, window, wind noise, and the like. In addition, in most countries, the upper limit of exhaust sound is regulated by law, and thus it is difficult to provide exhaust sound to the interior of the vehicle.

Accordingly, the driver can hardly hear the exhaust sound of his/her vehicle while sitting in the driver seat, which may make it difficult to roughly check for abnormalities of the engine through the exhaust sound and which may not meet the driver's taste.

The information disclosed in this Background of the Invention section is only for enhancement of understanding of the general background of the invention and should not be taken as an acknowledgement or any form of suggestion that this information forms the prior art already known to a person skilled in the art.

SUMMARY

Therefore, the present disclosure has been made in view of the above problems, and it is an object of the present disclosure to provide an exhaust sound control system for vehicles, which is capable of controlling the volume of exhaust sound transferred to the interior of the vehicle, thereby improving the sensorial quality related to sound generated while driving.

In accordance with the present disclosure, the above and other objects can be accomplished by the provision of an exhaust sound control system for vehicles including sound tunnel extending in the direction from a muffler to an occupant seat, the sound tunnel being hollow so that sound is transferred therethrough and having therein a through-hole through which external sound is introduced thereinto, and an exhaust valve device including a shaft, the shaft having one end portion penetrating an exhaust tube of the muffler, through which exhaust gas flows, in the axial direction and coupled to an exhaust valve provided to open and close a flow path of the exhaust tube, and an, opposite end portion extending toward the through-hole and coupled to an opening/closing valve provided to open and close the through-hole, wherein when the rotational position of the shaft is controlled by the operation of the exhaust valve device so that the flow path of the exhaust tube and the through-hole are opened, exhaust sound, generated by flow of the exhaust gas, is introduced into the sound tunnel through the through-hole and is transferred to the occupant seat.

The sound tunnel may be connected to a cabin configured to support a space for the driver seat in the vehicle body frame.

The exhaust valve device may include an exhaust housing fixed to one of the vehicle body and the exhaust tube of the muffler, and a driving motor disposed inside the exhaust housing, the driving motor being coupled with the shaft and configured to generate rotational force to axially rotate the shaft. The shaft may extend in the upward and downward directions and may have an intermediate portion coupled to the driving motor. The one end portion of the shaft may penetrate a lower end portion of the exhaust housing and the exhaust tube, and the opposite end portion of the shaft may penetrate an upper end portion of the exhaust housing and may extend to the through-hole.

The shaft may include a latching protrusion protruding from a portion between the opposite end portion and the intermediate portion of the shaft. A movement-absorbing member may be provided between the upper end portion of the exhaust housing and the latching protrusion of the shaft. The movement-absorbing member may be made of an elastic material.

The exhaust valve may be coupled to the one end portion of the shaft so as to be rotated together with the shaft, and may include an opening/closing surface arranged in the axial direction of the shaft and formed corresponding to the shape of the flow path of the exhaust tube.

The opening/closing valve may be coupled to the opposite end portion of the shaft and may be rotatable together with the shaft, and may include an opening/closing surface formed at the tip of the opposite end portion of the shaft in the horizontal direction. The opening/closing surface may have therein a communication hole formed corresponding to the through-hole.

The opening/closing valve may be formed in a circular shape. The sound tunnel may have therein a receiving recess formed corresponding to the shape of the opening/closing valve. The receiving recess may be formed concavely in a circular shape to receive the opening/closing valve therein, and the through-hole may be formed in the receiving recess.

The communication hole in the opening/closing valve may be located so as to communicate with the through-hole, where the exhaust valve opens the flow path due to the rotation of the shaft. The communication hole may be located so as not to communicate with the through-hole, where the exhaust valve closes the flow path.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF THE PREFERRED EMBODIMENTS

Reference will now be made in detail to the preferred embodiments of the present disclosure, examples of which are illustrated in the accompanying drawings. Wherever possible, the same reference numbers will be used throughout the drawings to refer to the same or like parts.

Figure 1:
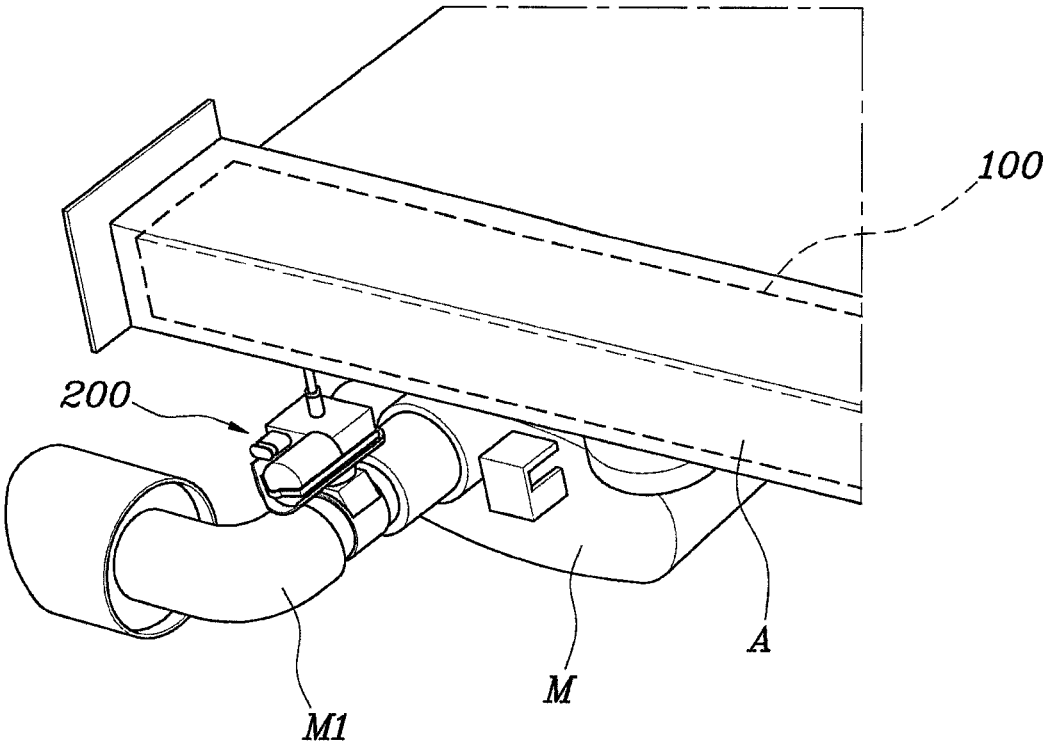
FIG. 1 is a view showing an exhaust sound control system for vehicles according to an embodiment of the present disclosure.

FIG. 1 is a view showing an exhaust sound control system for vehicles according to an embodiment of the present disclosure, and FIGS. 2 to 6 are views concretely showing the exhaust sound control system for vehicles shown in FIG. 1.

Figure 2:
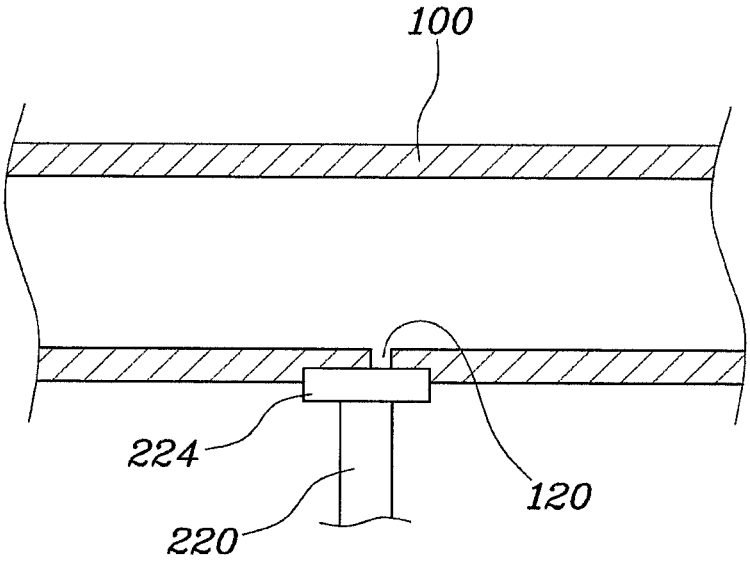
FIGS. 2 to 6 are views concretely showing the exhaust sound control system for vehicles shown in FIG. 1.
Figure 3:
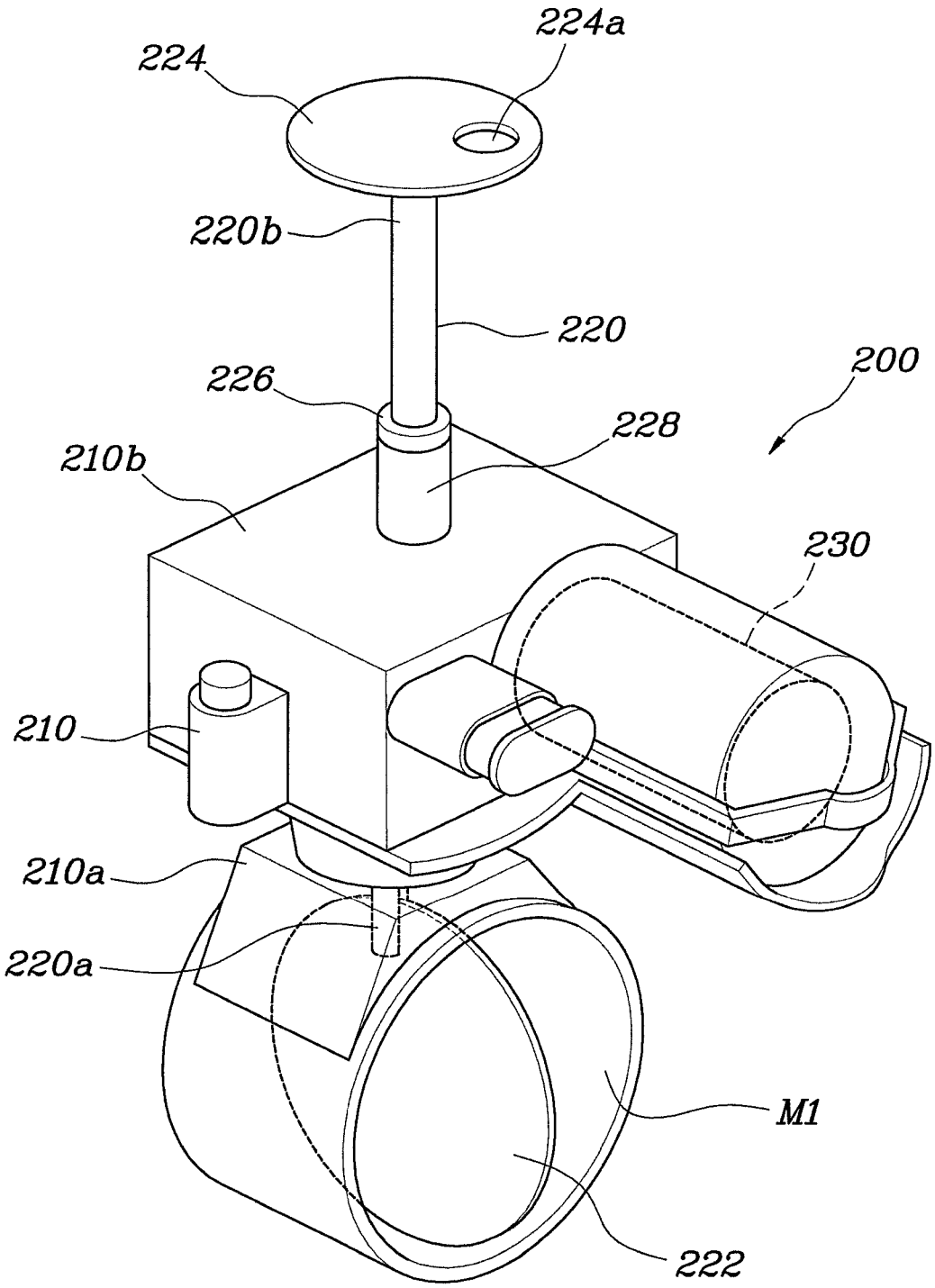

As shown in FIGS. 1 to 3, the exhaust sound control system for vehicles according to the present disclosure includes a sound tunnel 100, which extends in the direction from a muffler M to an occupant seat and which is hollow so that sound is transferred therethrough and has therein a through-hole 120, through which external sound is introduced thereinto, and an exhaust valve device 200, which includes a shaft 220, one end portion 220*a* of which penetrates an exhaust tube M1 of the muffler M, through which exhaust gas flows, in the axial direction and is coupled to an exhaust valve 222 provided to open and close the flow path of the exhaust tube M1, and an opposite end portion 220*b* of which extends toward the through-hole 120 and is coupled to an opening/closing valve 224 provided to open and close the through-hole 120. When the rotational position of the shaft 220 is controlled by the operation of the exhaust valve device 200 so that the flow path of the exhaust tube M1 and the through-hole 120 are opened, exhaust sound, generated by the flow of the exhaust gas, is introduced into the sound tunnel 100 through the through-hole 120 and is transferred to the occupant seat.

As described above, according to the present disclosure, which includes the sound tunnel 100 and the exhaust valve device 200, it is possible to transfer the exhaust sound to the occupants through the sound tunnel 100 while controlling the exhaust sound using the exhaust valve device 200.

The sound tunnel 100 may be formed integrally with or separately from the vehicle body frame. The sound tunnel 100 may be disposed on the exhaust valve device 200, which is mounted to the exhaust tube M1 of the muffler M, and may extend in the direction from the muffler M to the occupant seat so that the exhaust sound introduced into the sound tunnel 100 is transferred to the occupant seat. The exhaust valve device 200 is provided in order to selectively transfer the exhaust sound into the sound tunnel 100. The exhaust valve device 200 includes the shaft 220, one end portion 220*a* of which penetrates the exhaust tube M1 of the muffler M, through which the exhaust gas flows, in the axial direction and is coupled to the exhaust valve 222 for opening and closing the flow path of the exhaust tube M1, and the opposite end portion 220*b* of which extends toward the through-hole 120 and is coupled to the opening/closing valve 224 for opening and closing the through-hole 120. In this exhaust valve device 200, the positions of the exhaust valve 222 and the opening/closing valve 224 are determined depending on the rotational position of the shaft 220. In this manner, the amount of the exhaust gas flowing through the exhaust tube M1 is controlled. At the same time, the exhaust sound, generated by the flow of the exhaust gas, is selectively introduced into the sound tunnel 100 through the through-hole 120.

Figure 4:
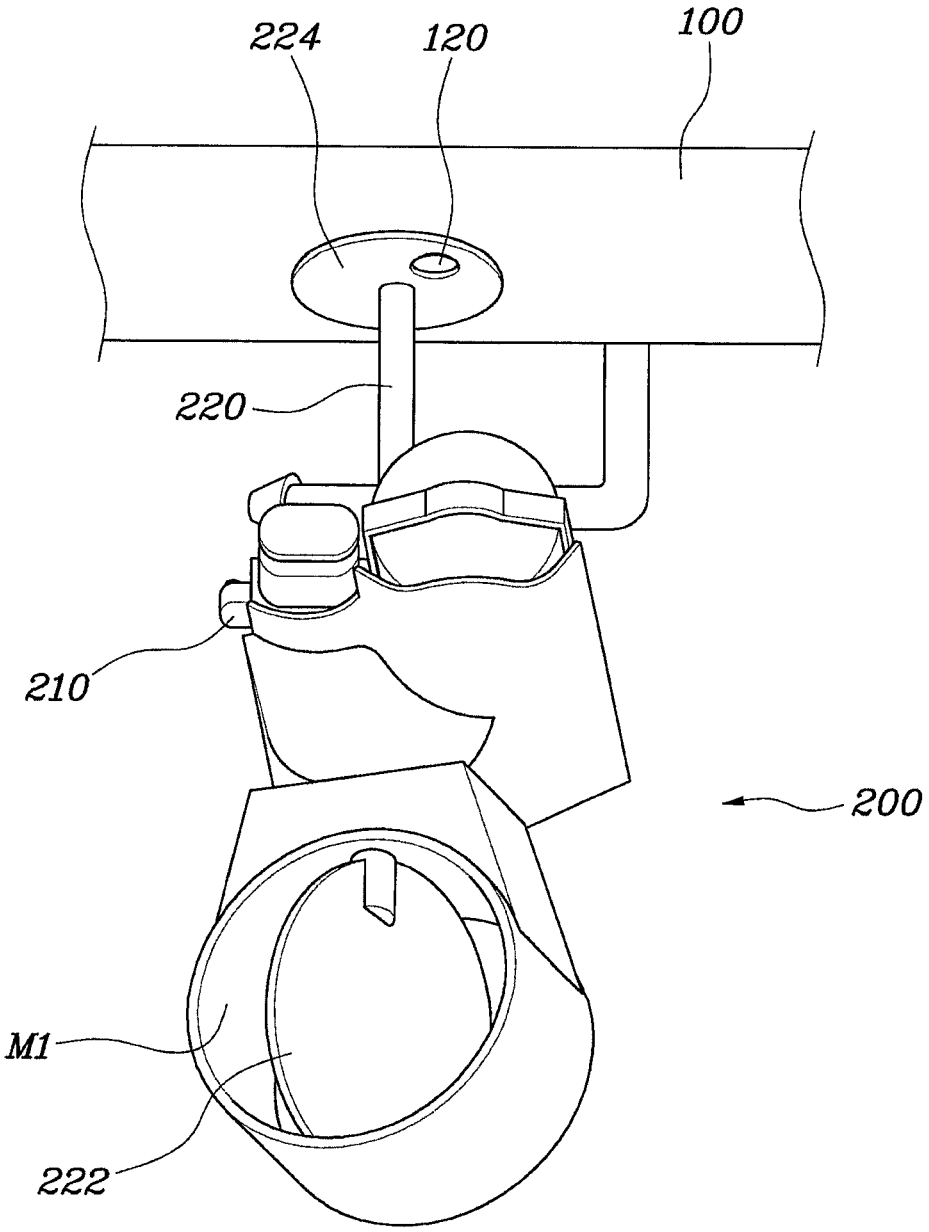

When the driver wants a sporty driving sensation, as shown in FIG. 4, the rotational position of the shaft 220 is controlled by the operation of the exhaust valve device 200 so that the flow path of the exhaust tube M1 and the through-hole 120 are opened, whereby the exhaust sound, which is generated by the flow of the exhaust gas through the flow path, is introduced into the sound tunnel 100 through the through-hole 120 and is transferred to the occupant seat. In this manner, the exhaust sound is transferred to the interior of the vehicle, thereby meeting the driver's demand for a sporty driving sensation.

Figure 5:
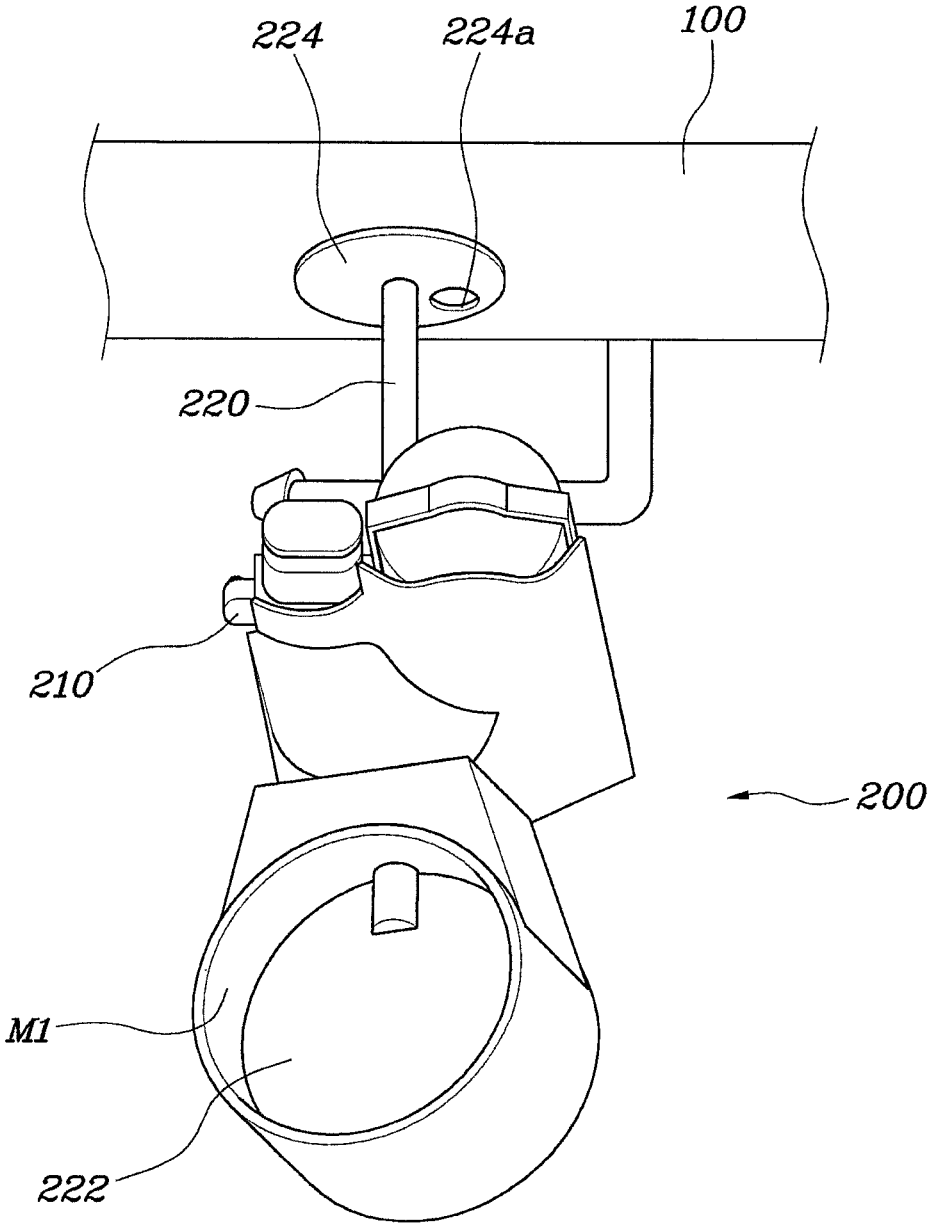

On the other hand, when the driver wants a silent driving sensation, as shown in FIG. 5, the rotational position of the shaft 220 is controlled by the operation of the exhaust valve device 200 so that the flow path of the exhaust tube M1 and the through-hole 120 are closed, whereby the volume of the exhaust sound, which is generated by the flow of the exhaust gas through the flow path of the exhaust tube M1, is reduced, and the exhaust sound is prevented from being introduced into the sound tunnel 100 through the through-hole 120. As a result, the volume of the exhaust sound transferred to the occupant seat is minimized.

As described above, according to the present disclosure, in a sporty driving mode, exhaust sound is permitted to be transferred to the interior of the vehicle, and in a silent driving mode, the volume of exhaust sound transferred to the interior of the vehicle is minimized. That is, the volume of exhaust sound transferred to the interior of the vehicle is varied depending on the driving mode desired by the driver. Accordingly, the sensorial quality related to sound generated while driving is improved.

A detailed description of the present disclosure will now be made. The sound tunnel 100 may be connected to a cabin, which supports space for the driver seat in the vehicle body frame A. The vehicle body frame A and the cabin vary depending on the kind of vehicle, and thus an illustration thereof is omitted in the drawings. The cabin is a structure that supports space for the driver seat as well as various devices operated by the driver, such as an accelerator pedal, a shift lever and a steering wheel. Thus, if the exhaust sound is transferred to the cabin, the driver may easily feel the exhaust sound.

Therefore, the sound tunnel 100 is connected to the cabin so that the exhaust sound introduced into the sound tunnel 100 is transferred to the driver seat through the cabin. Accordingly, the exhaust sound is easily and mainly transferred to the driver seat in the interior of the vehicle. The cabin is formed so as to communicate with the hollow space in the sound tunnel 100 in order to effectively transfer the exhaust sound. The cabin and the sound tunnel 100 may be formed integrally with each other as a part of the vehicle body frame.

As shown in FIG. 3, the exhaust valve device 200 may include an exhaust housing 210, which is fixed to the vehicle body or to the exhaust tube M1 of the muffler M, and a driving motor 230, which is disposed inside the exhaust housing 210 and which is coupled with the shaft 220 and generates rotational force to axially rotate the shaft 220.

The exhaust housing 210 may be formed through assembly of the upper part and the lower part thereof, which are separately provided. The driving motor 230, which generates rotational force to rotate the shaft 220, is provided inside the exhaust housing 210. The shaft 220 is mounted to the driving motor 230. The shaft 220 may be directly coupled to the driving motor 230, or may be coupled to the driving motor 230 via gear engagement. Thus, the shaft 220 is rotated by the operation of the driving motor 230.

Specifically, the shaft 220 extends from the exhaust housing 210 in the upward and downward directions so as to be connected to the sound tunnel 100 and the exhaust tube M1. In greater detail, the shaft 220 may be formed such that the intermediate portion thereof is coupled to the driving motor 230 so as to receive rotational force, the one end portion 220*a* thereof penetrates the lower end portion 210*a* of the exhaust housing 210 and the exhaust tube M1, and the opposite end portion 220*b* thereof penetrates the upper end portion 210*b* of the exhaust housing 210 and extends to the through-hole 120.

Therefore, when the shaft 220 is rotated by the operation of the driving motor 230, the exhaust valve 222, which is coupled to the one end portion 220*a* of the shaft 220, and the opening/closing valve 224, which is coupled to the opposite end portion 220*b* of the shaft 220, may be rotated at the same time, and the flow path of the exhaust tube M1 and the through-hole 120 in the sound tunnel 100 may be selectively opened or closed depending on the rotational position of the shaft 220.

In greater detail, as shown in FIGS. 3 to 5, the exhaust valve 222 may be coupled to the one end portion 220*a* of the shaft 220 so as to be rotated together with the shaft 220. The exhaust valve 222 may include an opening/closing surface, which is arranged in the axial direction of the shaft 220 and is formed corresponding to the shape of the flow path of the exhaust tube M1.

The opening/closing valve 224 may be coupled to the opposite end portion 220*b* of the shaft 220 so as to be rotated together with the shaft 220. The opening/closing valve 224 may include an opening/closing surface, which is formed at the tip of the opposite end portion 220*b* of the shaft 220 in the horizontal direction and has therein a communication hole 224*a* formed corresponding to the through-hole 120.

When the exhaust valve 222 opens the flow path due to the rotation of the shaft 220, the communication hole 224*a* in the opening/closing valve 224 may be located so as to communicate with the through-hole 120. On the other hand, when the exhaust valve 222 closes the flow path, the communication hole 224*a* may be located so as not to communicate with the through-hole 120.

As described above, the exhaust valve 222 is coupled to the one end portion 220*a* of the shaft 220, and the opening/closing valve 224 is coupled to the opposite end portion 220*b* of the shaft 220. Since the opening/closing surface of the exhaust valve 222 is arranged in the axial direction of the shaft 220 and is formed corresponding to the shape of the flow path of the exhaust tube M1, the degree of opening of the exhaust valve 222 varies depending on the rotational position of the shaft 220. In addition, the opening/closing surface of the opening/closing valve 224 is formed at the tip of the opposite end portion 220*b* of the shaft 220 in the horizontal direction. Typically, because the muffler M is disposed at the lower side of the vehicle body, the exhaust valve device 200 is also disposed at the lower side of the vehicle body so that the opening/closing valve 224 is brought into contact with the bottom surface of the sound tunnel 100. That is, the opening/closing surface of the opening/closing valve 224, which has therein the communication hole 224*a* formed corresponding to the through-hole 120, is formed at the tip of the shaft 220 in the horizontal direction so as to be in close contact with the sound tunnel 100. Therefore, the amount of exhaust sound introduced into the sound tunnel 100 through the through-hole 120 is controlled by the rotational position of the shaft 220.

When the exhaust valve 222 opens the flow path due to the rotation of the shaft 220, the communication hole 224*a* in the opening/closing valve 224 communicates with the through-hole 120, and when the exhaust valve 222 closes the flow path, the communication hole 224*a* does not communicate with the through-hole 120. In this manner, the flow path of the exhaust tube M1 and the through-hole 120 in the sound tunnel 100 are opened or closed together.

For example, when the driver wants a sporty driving sensation, the exhaust valve 222 is controlled so as to perform an opening operation to increase the amount of exhaust gas flowing through the exhaust tube M1, and the opening/closing valve 224 is also controlled so as to perform an opening operation, to thereby permit an exhaust sound, generated by the flow of the exhaust gas, to be introduced into the sound tunnel 100 and to be transferred to the driver. On the other hand, when the driver wants a silent driving sensation, both the exhaust valve 222 and the opening/closing valve 224 are controlled so as to perform a closing operation, to thereby minimize the volume of the exhaust sound transferred to the driver.

With the above-described configuration, in which the exhaust valve 222 and the opening/closing valve 224 are controlled so as to perform an opening operation together or to perform a closing operation together, it is possible to vary the volume of the exhaust sound provided to the driver depending on the driver's demand for a sporty driving sensation or a silent driving sensation.

As shown in FIG. 3, the shaft 220 may include a latching protrusion 226, which protrudes from a portion between the opposite end portion 220*b* and the intermediate portion of the shaft 220. A movement-absorbing member 228, which is made of an elastic material, may be provided between the upper end portion 210*b* of the exhaust housing 210 and the latching protrusion 226 of the shaft 220.

When the exhaust valve device 200 moves upwards and downwards by a certain displacement while the vehicle is traveling, the movement-absorbing member 228, which elastically supports the shaft 220 and the exhaust housing 210, absorbs the displacement, whereby the opening/closing valve 224, coupled to the shaft 220, may be stably maintained in close contact with the sound tunnel 100. The movement-absorbing member 228 may be formed so as to surround the shaft 220, and may be fixedly provided between the latching protrusion 226 of the shaft 220 and the upper end portion 210*b* of the exhaust housing 210, thereby stably and elastically supporting the shaft 220 without being separated from the shaft 220.

Figure 6:
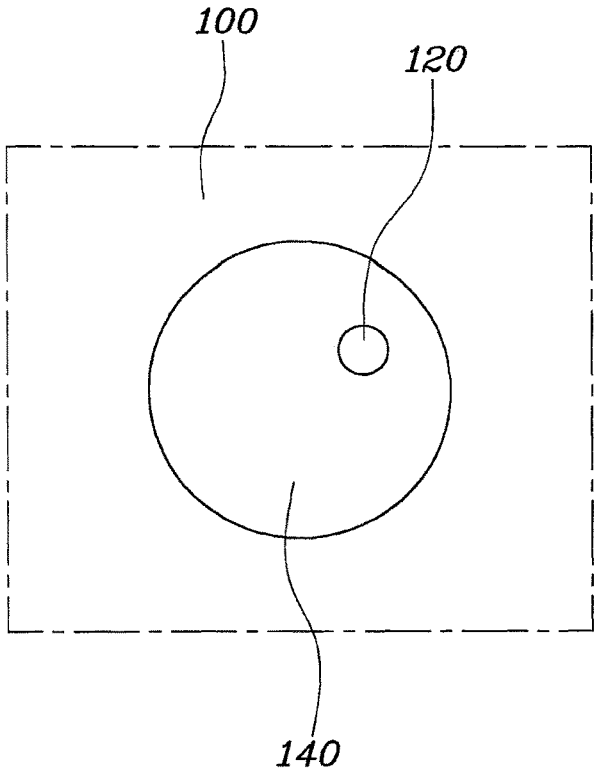

As shown in FIG. 6, the opening/closing valve 224 may be formed in a circular shape, and the sound tunnel 100 may have therein a receiving recess 140 formed corresponding to the shape of the opening/closing valve 224. That is, the receiving recess 140 may be formed concavely in a circular shape so that the opening/closing valve 224 is received therein. The through-hole 120 may be formed in the receiving recess 140.

With the configuration in which the opening/closing valve 224 is formed in a circular shape and the sound tunnel 100 includes the circular-shaped receiving recess 140, the opening/closing valve 224 may be smoothly rotated together with the shaft 220 while being received in the receiving recess 140. In addition, since the receiving recess 140 is formed concavely in the outer surface of the sound tunnel 100, the opening/closing valve 224 may be fitted into the receiving recess 140 so that the position of the opening/closing valve 224 is fixed. As a result, it is possible to prevent the shaft 220 from being bent and to enable the communication hole 224*a* in the opening/closing valve 224 accurately communicate with or not to communicate with the through-hole 120 in the sound tunnel 100.

As is apparent from the above description, an exhaust sound control system for vehicles according to the present disclosure includes an exhaust valve device that controls the volume of exhaust sound by controlling the amount of exhaust gas flowing through a muffler. Accordingly, in a sporty driving mode, exhaust sound is permitted to be transferred to the interior of the vehicle, and in a silent driving mode, the volume of exhaust sound transferred to the interior of the vehicle is minimized. That is, the volume of exhaust sound transferred to the interior of the vehicle is varied depending on the driving mode desired by the driver. Accordingly, the sensorial quality related to sound generated while driving is improved.

Although the preferred embodiment of the present disclosure has been disclosed for illustrative purposes, those skilled in the art will appreciate that various modifications, additions and substitutions are possible, without departing from the scope and spirit of the invention as disclosed in the accompanying claims.

What is claimed is:

1. An exhaust sound control system for vehicles, comprising:

a sound tunnel extending in a direction from a muffler to an occupant seat, the sound tunnel being hollow so that sound is transferred therethrough and having therein a through-hole through which external sound is introduced thereinto; and an exhaust valve device comprising a shaft, the shaft having one end portion penetrating an exhaust tube of the muffler, through which exhaust gas flows, in an axial direction and coupled to an exhaust valve provided to open and close a flow path of the exhaust tube, and an opposite end portion extending toward the through-hole and coupled to an opening/closing valve provided to open and close the through-hole, wherein when a rotational position of the shaft is controlled by operation of the exhaust valve device so that the flow path of the exhaust tube and the through-hole are opened, exhaust sound, generated by flow of the exhaust gas, is introduced into the sound tunnel through the through-hole and is transferred to the occupant seat.

2. The exhaust sound control system according to claim 1, wherein the sound tunnel is connected to a cabin configured to support a space for a driver seat in a vehicle body frame.

3. The exhaust sound control system according to claim 1, wherein the exhaust valve device comprises:

an exhaust housing fixed to one of a vehicle body and the exhaust tube of the muffler; and a driving motor disposed inside the exhaust housing, the driving motor being coupled with the shaft and configured to generate rotational force to axially rotate the shaft, wherein the shaft extends in upward and downward directions and has an intermediate portion coupled to the driving motor, wherein the one end portion of the shaft penetrates a lower end portion of the exhaust housing and the exhaust tube, and wherein the opposite end portion of the shaft penetrates an upper end portion of the exhaust housing and extends to the through-hole.

4. The exhaust sound control system according to claim 3, wherein the shaft comprises a latching protrusion protruding from a portion between the opposite end portion and the intermediate portion of the shaft, and wherein a movement-absorbing member is provided between the upper end portion of the exhaust housing and the latching protrusion of the shaft, the movement-absorbing member being made of an elastic material.

5. The exhaust sound control system according to claim 1, wherein the exhaust valve is coupled to the one end portion of the shaft and is rotatable together with the shaft, and comprises an opening/closing surface arranged in an axial direction of the shaft and formed corresponding to a shape of the flow path of the exhaust tube.

6. The exhaust sound control system according to claim 1, wherein the opening/closing valve is coupled to the opposite end portion of the shaft and is rotatable together with the shaft, and comprises an opening/closing surface formed at a tip of the opposite end portion of the shaft in a horizontal direction, the opening/closing surface having therein a communication hole formed corresponding to the through-hole.

7. The exhaust sound control system according to claim 6, wherein the opening/closing valve is formed in a circular shape, wherein the sound tunnel has therein a receiving recess formed corresponding to a shape of the opening/closing valve, the receiving recess being formed concavely in a circular shape to receive the opening/closing valve therein, and wherein the through-hole is formed in the receiving recess.

8. The exhaust sound control system according to claim 6, wherein the communication hole in the opening/closing valve is located so as to communicate with the through-hole, where the exhaust valve opens the flow path due to rotation of the shaft, and wherein the communication hole is located so as not to communicate with the through-hole, where the exhaust valve closes the flow path.

* * * * *